United States Patent [19]

King et al.

[11] 4,068,103

[45] Jan. 10, 1978

[54] LOUDSPEAKER SOLDERLESS CONNECTOR SYSTEM AND METHOD OF SETTING CORRECT PIGTAIL LENGTH

[75] Inventors: John A. King, Mentor, Ohio; Gerald Elloit Murphy, II, Kalamazoo, Mich.

[73] Assignee: Essex Group, Inc., Fort Wayne, Ind.

[21] Appl. No.: 583,909

[22] Filed: June 5, 1975

[51] Int. Cl.[2] ..... H04R 9/02; H04R 31/00

[52] U.S. Cl. ..... 179/115.5 VC; 29/594; 339/241

[58] Field of Search ..... 179/115.5 R, 115.5 VC, 179/1 PC; 29/594; 339/241, 244 R

[56] References Cited

U.S. PATENT DOCUMENTS 3,609,652 9/1971 Sebastian ..... 179/115.5 R

*Primary Examiner*—George G. Stellar

*Attorney, Agent, or Firm*—Anthony J. Criso

[57] ABSTRACT

A solderless connector for joining the flexible electrical moving leads connecting the voice coil of a loudspeaker to the electrical input terminals located on the loudspeaker frame. The connector supplies electrical continuity between the flexible conductor and the terminal, and mechanically secures the flexible conductor without the need for solder or other mechanical means, thereby improving efficiency of assembly and improving quality by eliminating problems attributable to poor workmanship in soldering operations. These movable leads are known as pigtails, and their length is adjusted to insure long life and to eliminate distortion. A pigtail that is too short will limit cone excursion by becoming taut and introduce distortion into the acoustical output. A short pigtail will also result in early failure of the loudspeaker due to the excessive stress. A pigtail that is too long will also introduce distortion due to the generation of spurious noise. The method of ensuring correct pigtail length employs a dressing fixture.

7 Claims, 11 Drawing Figures

LOUDSPEAKER SOLDERLESS CONNECTOR SYSTEM AND METHOD OF SETTING CORRECT PIGTAIL LENGTH

BACKGROUND OF THE INVENTION a. Field of the Invention

This invention is in the field of solderless spade-type electrical connectors, in which a clamping means is used to immobilize a bendable strand or lead to dispose and secure the lead between surfaces urged towards each other to grasp the part therebetween and in which the clamping force is exerted by a resilient blade portion of the connector along one edge in cantilever fashion, the spade type connector being especially useful for immobilizing the moving lead portion of the loudspeaker for connection to the electrical power input terminals. The field of the invention includes the method of joining of an electrical conductor in the form of a bendable or flexible strand or lead to a solderless electrical connector which is of the spade-type of solderless connector.

b. Description of the Prior Art

Heretofore the connection of the flexible moving leads of a loudspeaker to the electrical power input terminals have been accomplished by soldering in an assembly line manufacturing facility. The requirement of the soldering operation is to provide for a low loss electrical and mechanical termination of the flexible moving leads and unrestricted movement of the loudspeaker moving system within its design limitations, the loudspeaker moving system comprising the voice coil, spider, and cone.

The termination of the flexible moving leads must be such that no mechanical slippage in use occurs which could result in subsequent snubbing of the leads in response to the motion of the loudspeaker moving system.

The flexible moving leads must be secured so that conversely slippage could not increase the length which could result in the leads rubbing against some portion of the loudspeaker frame or terminal board or against each other in response to motion of the loudspeaker moving system.

In the prior art of soldering, rising labor costs have been encountered and meticulous inspection is required to insure against defective solder joints and molten solder dropping onto its moving system parts resulting in faulty performance of the loudspeaker. A high degree of skill is needed.

Solderless connectors have not heretofore been proposed for the present use, and the known connectors, such as in Rutter, U.S. Pat. No. 3,065,451, Cobaugh, U.S. Pat. No. 3,191,281, Cobaugh, U.S. Pat. No. 3,239,918, and Cobaugh, U.S. Pat. No. 3,243,757, are not structurally suitable to meet the requirements heretofore met by the soldered connection for the flexible leads of the loudspeaker connection to the power source.

In Rutter, U.S. Pat. No. 3,065,451, the engagement of the flexible lead wire is to a projecting tip which fits into a retaining element. This type of connection (male-female) is unsuitable to the present loudspeaker connection, because there is no provision of the free ends of the leads after immobilizing the portion of the lead connected to the speaker.

Similarly, in the Cobaugh U.S. Pat. Nos. 3,191,281, 3,239,918, and 3,243,757, special retaining channels are provided for crimping a wire, but the action of the clamping part is such as to produce an S-shaped bend at an exposed corner of the connector which permits the free end of the wire or strand to work back and forth, thereby becoming brittle and tend to break.

OBJECTS OF THE INVENTION

An object of the invention is to provide a novel spring-biased connecting means for mechanically and electrically terminating the flexible electrical conductor of a loudspeaker to the electrical input terminals without the use of solder.

A further object of the invention is to provide a method for mechanically connecting the flexible electrical conductors from the voice coil of a loudspeaker to the electrical input terminals in a way that insures long life for the assembly.

A further object of the invention is to provide a method for adjusting the length of the movable leads or pigtails on a loudspeaker in order to eliminate distortion, improve the performance of the loudspeaker, and to eliminate rejects in manufacture due to improperly dressed leads.

A further object of the invention is to provide the solderless pigtail-terminal connector which eliminates manufacturing rejects and field failures due to spurious noise resulting from loose solder rattling between the cone periphery and the basket which occurs in a conventional soldered connection due to the use of excess solder during the soldering operation.

Further objects and features of our invention will best be understood and appreciated from a detailed description of the preferred embodiments thereof, selected for purposes of illustration, and shown in the accompanying drawing.

SUMMARY OF THE INVENTION a. Method of Setting Pigtail Length for Connection to a Solderless Connector The method of setting pigtail length in a solderless connection is critical to assuring audio quality, overcoming mechanical failure, and meeting the essential environmental factors. This setting of the pigtail length is called "dressing."

b. Method Features Controlling Audio Quality

The pigtails on a loudspeaker must be dressed in accordance with the invention to allow cone excursions limited only by cone suspension and spider characteristics and the mechanical design of the loudspeaker in order to avoid deleterious effects on the acoustical performance of the loudspeaker. A pigtail that is too short will limit cone excursion in response to electrical excitation of the voice coil by becoming taut at some point in the excursion and thus introduce distortion into the acoustical output, i.e., the acoustical output waveform will no longer be a replica of the electrical input waveform. A short pigtail will also result in early failure of the loudspeaker due to the excessive stress on the pigtail-voice coil wire joint. A pigtail that is too long may also introduce distortion due to the generation of spurious noise. Spurious noise will occur if portions of the pigtail touch the basket or the cone at any time during an excursion of the cone. The spurious noise will usually occur at discrete frequency which correspond to resonant modes of the pigtail determined by its distributed mass and stiffness. Excessive pigtail length can also allow the pigtail to touch each other resulting in an electrical short circuit with attendant loss in output. In summation, pigtails of the proper length dressed in accordance with the invention will allow full design excursion of the cone and not generate spurious noise at any frequency during operation of the speaker.

C. Method Features Meeting Environmental Requirements

The solderless connector assembly of the invention will withstand the following tests which are required for serviceability in severe stress applications such as in automotive installations.

Humidity-Temperature cycling: 5 cycles of 98% R.H., and 190° F. heat.

Conductance: 15 micro-ohm maximum resistance after Humidity-Temperature cycling.

Pull Test: Pigtail wire breaks at 10 lbs. — no break at connector; 30 - 35 lbs. pull on terminal without failure.

The solderless pigtail-terminal connector and proper dressing eliminate manufacturing rejects and field failures due to spurious noise resulting from molten solder dropping into the cone and becoming loose during operation so that it can rattle between the cone periphery and the basket which occurs in a conventional soldered connection due to the use of excess solder during the soldering operation.

d. Unobvious Features of the Connector

The solderless electrical connector assembly of the present invention comprises a spade type resilient slip or socket connector which joins the moving leads, called pigtails, of the voice coil to fixed leads of the space members engaging the sockets or openings of the connector. The connector comprises a generally flat solderless connector web mounted adjacent to the moving coil and cone of the loudspeaker at the back of the speaker, the web being formed with openings at its opposite ends into each end of which is fitted flat blade means having a thin edge which transversely presses against the movable leads in electrically conducting relation so that on each side of the web a pressing connection is made between the movable leads by transverse pressing of the thin edge blade means clamped to the fixed leads at its trailing end.

The passage of the aperture at each end is so dimensioned as to closely conform to the outlines of the blade and a flexible struck-out tongue portion of the space series to engage the edge of an opening at the top and adjacent the end of the web portion thereby detenting the blade solidly within the passageway.

The central portion of the connector web is provided on an edge thereof with slotted openings each of which is wider than the diameter of the movable leads or pigtails so that the wires are slid into the slot to be captured by the thin edge and locked in place by the spring action of the struck-out tongue portion.

The moving voice coil which is the most delicate part of the loudspeaker must be mounted for free movement in order to avoid rubbing against pole survaces with concommitant unwanted noise generation and to avoid striking pole surfaces which could occur as a result of rough handling during installation or transport. The axial positioning of the coil in the gap can also be incorrect if the leads are pulled, and the attachment of these leads to the cone, usually a paper cone, requires very careful assembling in order to avoid undue interference with the resilient mounting portion of the cone in the outer frame of the speaker.

The web portion of the connector of the invention may be part of the frame structure and molded in a single piece therewith or it may be mounted on to the frame structure by means of a mounting bracket or tang. The web of the connector may be L-shaped or may have its openings at the ends lying along a common axis or along divergent axes.

DESCRIPTION OF THE PREFERRED EMBODIMENTS

The embodiments of a loudspeaker solderless connector of the invention relate to typical moving coil loudspeakers in which the pigtail lengths are preadjusted for length to eliminating distortion caused by tightness during the excursion of the voice coil or where distortion is caused by pigtails which are too long which allow the pigtail to vibrate against the loudspeaker frame with attendant spurious noise generation. Reference is made to page 208 of the Dictionary of Electronics by S. Handel, Penguin Reference Books, 1962, published by Penguin Books, Inc., Baltimore, Md., which shows a cross-section of a typical permanent-magnet moving-coil loudspeaker.

Figure 1:
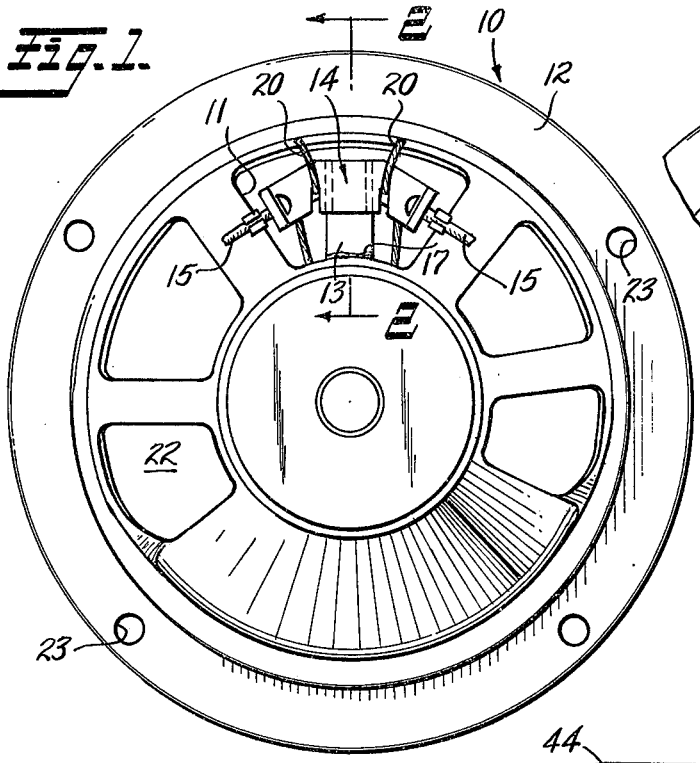
FIG. 1 is a plan view of a speaker employing the solderless electrical connector of the present invention.
Figure 2:
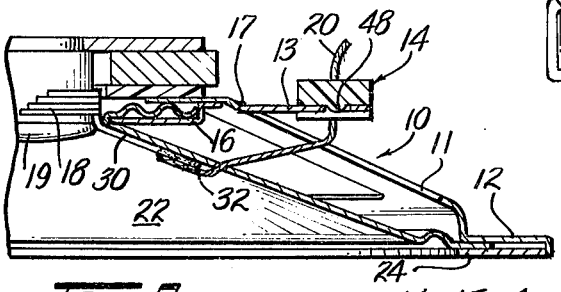
FIG. 2 is an enlarged fragmentary vertical sectional view, taken on the line 2—2 of FIG. 1.

If the magnet of this dictionary may be an electromagnet as seen in this cross-section, which is incorporated herein by reference, the paper cone of the conventional moving coil loudspeaker is similar to that in the present drawings and is driven by the voice coil as a result of changes in the magnetic field and the arrows in the diagram in the dictionary show the movements of the coil to and fro over the pole piece. As shown in FIGS. 1 and 2, the conventional cone 22 has a resilient mounting at the periphery formed by accordian pleat(s) in the paper, plastic, rubber, or plastic foam from which the cone is formed, the resilient mounting generally extending to the very edge of the cone at the baffle. Some cones have a resilient surround made of cloth, rubber, or plastic foam bonded to the cone periphery. The moving leads which are termed pigtails in the application are the voice coil leads which are generally threaded through the interior conical portion of the cone are generally soldered to a terminal at the back of the speaker in the conventional construction but which are held by the solderless connector in accordance with the invention. In the cross-section shown in the dictionary, these movable pigtails to the voice coil are shown as being directed to the signal amplifier output transformer, but obviously with the present state of circuit and loudspeaker design, they may be connected to any electrical energy signal source. The problem for terminating the flexible leads or pigtails for anchoring these leads under conditions that no mechanical slippage occurs, to prevent snubbing in response to the voice coil excursion, to eliminate excess length and resultant vibration against the frame, and to facilitate assembly, will readily be understood from the cross-section shown in the dictionary. The solderless connector embodiments shown in the present figures are illustrative of a permanent magnet type of moving coil loudspeaker, as shown in the dictionary, but may also obviously be used with an electromagnet moving coil loudspeaker which has the indentical flexible electrical moving leads or pigtails connected to the voice coil.

Figure 3:
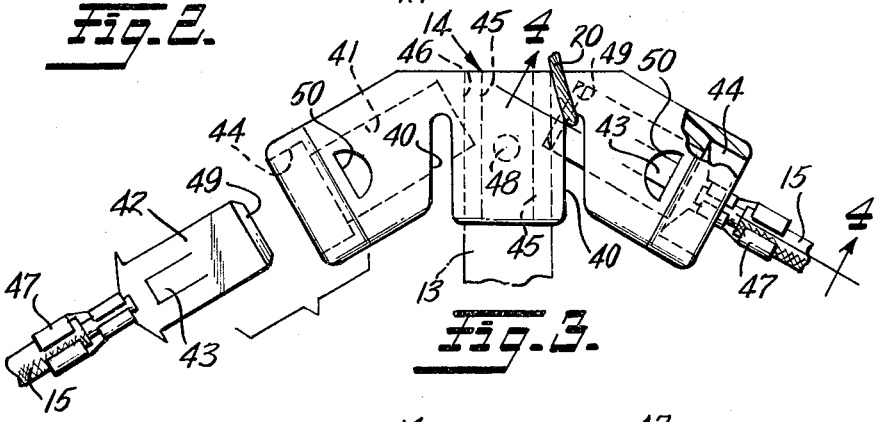
FIG. 3 is an enlarged plan view of the connector of FIG. 1, partially in section and showing the left hand terminal blade detached from the connector.
Figure 4:
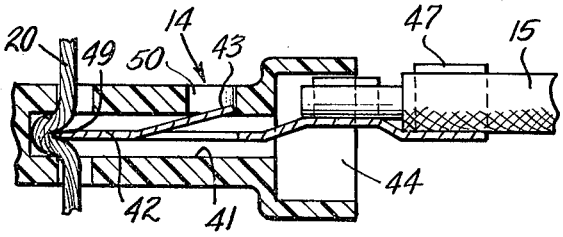
FIG. 4 is an enlarged fragmentary vertical sectional view, taken on the line 4—4 of FIG. 3.

Referring specifically to FIGS. 1, 2, 3 and 4, there is shown an example of one form of a solderless electrical connector assembly 14 of the invention which is mounted on a bracket 13, the bracket being secured to a typical permanent-magnet moving-coil loudspeaker 10 and connecting the pigtails thereof. The details of the solderless connector assembly and the secured pigtails are shown in FIGS. 2 and 4.

In the form of solderless connector of FIGS. 1–4, the connector assembly 14 is comprised of separable terminal blades of electrically conductive material 42 with detent projections 48, a terminal receptacle 14 of the electrically non-conducting material with slots 46, to align the flexible moving pigtails 20 in the receptacle, and mounting means consisting of a bracket 13 to secure the terminal receptacle to the loudspeaker frame 12 and a section of the receptacle 14 to accept and to hold the terminal blade detent projection under spring-biased action of the detent (see FIG. 4). The bracket 13 is secured at weed 17 to the frame 12.

Figure 9:
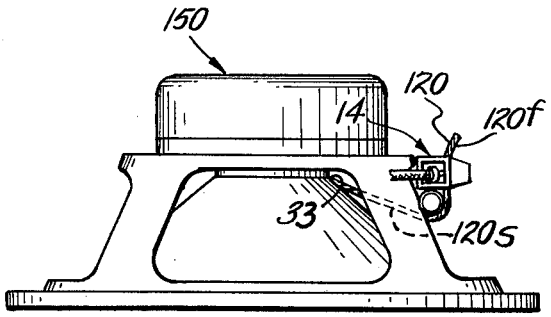
Figure 11:
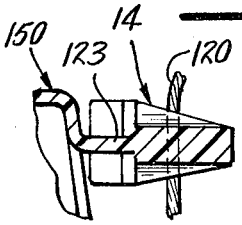
FIG. 11 is an enlarged fragmentary vertical section view, taken on the line 18—18 of FIG. 8, showing the support for the solderless terminal block being formed integral with the speaker basket.
Figure 10:
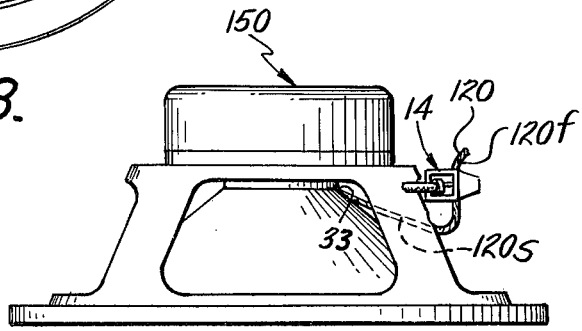

It should be noted that the mounting of the solderless connector may be on a bracket integral with the frame and both the bracket and terminal block can be made in the one piece with the speaker basket, which represents the alternate embodiment which is shown in FIGS. 9–11 wherein projecting tang 123 is in a projecting portion of the central circular part of the basket and fitted thereover in lock relation in the solderless terminal block 14. The basket with its conventional openings designed to provide proper acoustic back windows for the movement of air by the cone 22 can be made from metal or plastic material and die cast or molded with the integral projecting tang 123 or the tang 123 may be welded as shown in FIG. 1.

In FIGS. 1 and 2 there is shown the mounting of the solderless connector web 14 onto the flat mounting bracket 13, which is welded at welding joint 17 above one of the speaker apertures 11. As shown in FIG. 1, the basket of the speaker 10 has several apertures in a conventional design and comprises at its center the electromagnetic voice coil 18, the cones or diaphragm 22 surrounding the coil 18, the peripheral gasket or spacer 24 and the four spaced apart openings 23 in the frame 12 for mounting the speaker in the cabinet box or like enclosure by means of screw thread fasteners.

The bottom part of the pigtails 30 from the voice coil as shown in FIG. 2 must be immobilized at the inner center part of the frame below the cone 22 in order to provide movement of the cone and for this purpose an adhesive connection 32 serves to anchor each of the voice coil leads 30 to the back (or rear) surface of the cone 22 along a short glue line radiating from the area of the voice cone dust cap 19.

In some cases a speaker may have the pigtails joined to the voice coil on the outside surface of the coil form as shown in FIG. 2. The choice depends on manufacturing methods used.

By adhesively anchoring the pigtail portions 30 to the cone 22 at glue line 32, the impairment of the audio quality of the signal due to rubbing forces between the leads, the cone, and the speaker is eliminated in the bottom part adjacent the voice coil but constraints can arise which are due to the pigtail parts at the connection to the signal power source. The pigtails 32 at the top part are formed of electrically conductive material, preferably twisted tinsel and the free ends 20 of the pigtails are mechanically connected to the blades 42 of the connector assembly 14 in a predetermined length to complete the electrical circuit connection between the blades, pigtail portion 20, and lower portion which goes to the voice coil.

a. CRITICAL DRESSING OPERATION

1. Dressing and Retaining Function

Figure 8:
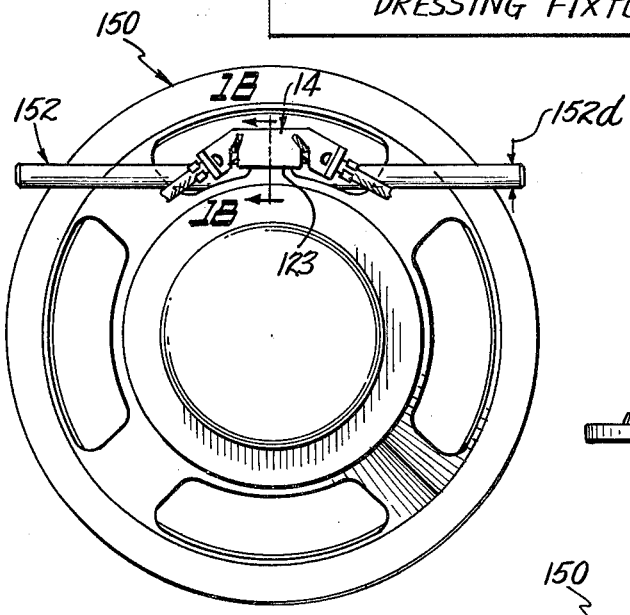
FIGS. 8–10 show the stages of the assembly.

The pigtail retaining function provided by the solderless connector mounted on the back of the speaker contributes to audio quality in view of the dressing operation as specifically shown in FIGS. 8, 10 and 11.

2. Dressing Operation

The dressing and retaining function method comprises the steps of:

a. inserting the lead wires from the voice coil into the terminal block;
b. installing the lead dressing fixture under the block;
c. pulling the flexible leads to tighten them against the dressing fixture while inserting the blade of the connector;
d. locking the blade by having the detent engage the stop; and,
e. removing the fixture.

3. The Dressing Triangle

The method disclosure referring to FIG. 8 and the dressing steps of FIGS. 10 and 11 will identify the longer leg of the triangle as constituting the distance in a straight line between the exit point on the cone to the entry on the thin blade edge securing point of the connector and the slack is measured as the third side or opposite side of the triangle.

The triangle need not be a right triangle. The amount of slack is a function of its size, shape, and location of the dressing fixture relative to the Terminal block.

The preferred embodiment illustrates a rod as the lead dressing fixture and the rod may be square or cylindrical in cross section. A tube could be used of cylindrical or square cross section. A flat tongue depressor may be used which is relatively thin yet wide.

In the various embodiments of the drawings, the pigtail retaining means are the same in each and are located on the back in a position, best shown in FIGS. 10 and 11, where there are two legs of a triangle, one leg is **120*s* and the other is 120*f*. As shown in FIGS. 10 and 11, leg 120*s* is the hypotenuse of a right triangle. Leg 120*f* is the short side. The opening at 32 in FIG. 11 is the point of exit from the diaphram at the outer diaphragm surface. The height, 120***f*, is a function of the diameter of the dressing fixture and in general the location of the dressing fixture relative to the terminal block. In the specific illustration the height 120*f* happens to be equal to the diameter of the dressing fixture. The length of the pigtail between the thin blade securing point and the point of exit from the diaphragm at 32 is equal to the hypotenuse 120*s* and the short side 120*f*. The short side 120*f* is a function of the diameter (or size) 152*d* in FIG. 9 and the location of the dressing fixture relative to the Terminal blade. The sum of 120*s* and 120*f* provides a length of capture pigtail (capture by the connector) which permits the free excursion of the voice coil.

As a matter of practical speaker design, the free excursion of the voice coil will be a maximum of ½ of the slack represented by 120*f* depending on the type of speaker $u_1$ high frequency tweeter, exhibit very small motion of the cone so therefore do not require as much pigtail slack, however, extra slack may be provided to use standard fixtures.

4. Degree of Excursion

The numerical value for slack is related to the excursion of the voice coil. It will vary with the type of speaker. For a speaker which is full range and has a very broad excursion of the voice coil, the coil may travel ½ of an inch in each direction from its center. For a mid range speaker the value will be much smaller, and for a high frequency speaker, the excursion is still less. A minimum of 1½ to 2 times the excursion represents a desired ratio of the slack to the excursion of the voice coil.

An illustrative example is a minimum of ¾ of an inch for a low range speaker and preferred value of 1 inch which is about 2 times the excursion. Greater values would provide too long a slack and could interfere with audio quality.

Another important aspect of the slack proportions is that the higher amount of slack is preferred for a woofer, and a lower ratio is preferred for a tweeter. The woofer value is about 2, and the tweeter value is about 1½.

There are described open back basket units, but closed back units, as well as open basket, may be used.

5. Embodiments of Retaining Openings

The relationship of the basket to the solderless connector provides a new and critical coaction in the invention. In the embodiment in which tang 13 is integral with the hub, we can make the basket in molded form so that the pigtails will be immobilized in a very precise fashion by means of a solderless connector and basket assembly all in one piece. The slots 66 serve as outlet retaining means for the pigtails and to define openings 50 as the anchoring inspection opening by means of which the connector may be checked.

Figure 6:
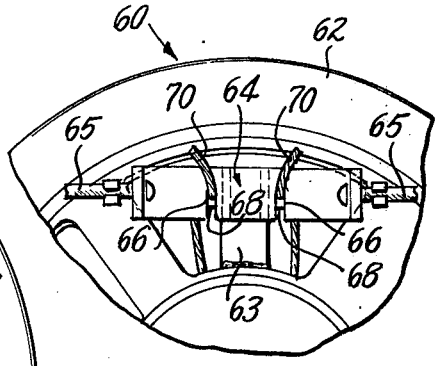
FIG. 6 is an enlarged plan view of an alternate embodiment of connector.
Figure 5:
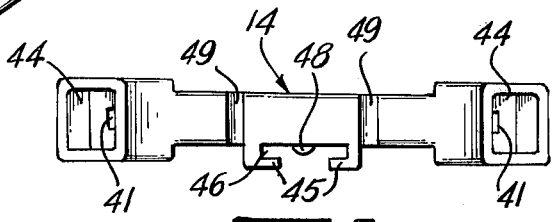
FIG. 5 is an elevational view of the connector.

The degrees of alignment, e.g., the angle made by 20 in FIG. 3 to the vertical line 45 in each of the connectors of FIG. 5, and 6, permit the angle to vary from 0° to −25° in FIG. 3 in order to bring the two pigtails together to a point for a braided connection.

Thus the generic holding structure constitutes the present solderless connector mounted on a tank which is integral with the basket and the limitations for length on the pigtails in terms of the triangular portions above mentioned whereby the specific problems are overcome, namely:

a. limited cone excursion introducing distortion into acoustical output;
b. failure due to excessive stress when the pigtail is too short;
c. distortion by generation of spurious noise when pigtail is too long so that it will touch the basket or the cone;
d. spurious noise due to resonant modes of the pigtail;
e. electrical short circuits when pigtails touch;
f. field failure due to loose solder rattlings when excess solder is used; and,
g. meeting environmental standards of humidity temperature cycling, conductance, and pull tests.

6. General Applicability of the Lead Dressing Connector System

The elimination of a solder connector while simultaneously providing a universally useable mechanical connection, which dresses the length of the moving leads to within very narrow tolerances, constitutes a simple, practical, yet entirely different basic change in the loudspeaker and its manufacture.

The present connector and lead dressing system useful for connection which will apply to all speakers wherein there is a requirement for the connection of movable leads from the cone or similar diaphragm to a post at which a connection is made to the signal power source feeding the voice coil of the speaker.

What is claimed is:

1. A moving coil loudspeaker having a solderless electrical connector assembly, wherein said connector comprises:

nonconductive terminal receptacles having a cavity to allow insertion of a blade;

a blade connector for each receptacle with each connector having a front end and a back end and being fastened at its back end to a lead going to the signal power source for said coil;

a detent in each of said receptacles;

a detent projection on each terminal blade to provide a lock fit of the terminal blades in the receptacles; and slots in the terminal receptacle suitably positioned to accept and align flexible moving leads which join the moving coil with the connector assembly so that upon insertion of each terminal blade, the flexible moving leads will be mechanically secured in the transverse direction in the terminal receptacle in a compressed state, each lead being pinched between the front end of a blade connector and its cooperating terminal receptacle thereby insuring a low electrical resistance contact between the flexible moving leads and the terminal blades without a need for solder or other mechanical connecting means.

2. The invention according to claim 1 including further mounting means for securing said connector to said loudspeaker, said mounting means comprising a tang on the back of said loudspeaker and flange portions on the back of said connector tightly fitting over said tang.

3. The invention according to claim 2 wherein said flexible moving leads are of predetermined lengths equal to the distance between the coil and said slots in the terminal receptacle added to about one and one-half to two times the excursion of said voice coil during acoustic radiation.

4. A moving coil loudspeaker having an electrically nonconducting molded plastic frame, flexible electrical moving leads connecting the electrical input terminals to the moving voice coil, and a solderless electrical connector secured to said loudspeaker comprising:

terminal receptacles which are an integral part of said electrical nonconducting molded plastic loudspeaker frame having a cavity of suitable dimensions to allow insertion of a terminal blade, each with a detent projection fitting into a cavity of said receptacle;

a detent section in each cavity which will accept the detent projection on the terminal to result in a locked fit of the terminal blades in the receptacles and thereby prevent removal of slippage of the terminal blades except with the use of a special removal tool; and slots in the terminal receptacle suitably positioned to accept and align the flexible moving leads so that upon insertion of the terminal blade the flexible moving leads will be mechanically secured in the terminal receptacles in a compressed state, each lead being pinched between the front end of a blade connector and its cooperating terminal receptacle thereby insuring a suitable low electrical resistance contact between the flexible moving leads and the terminal blades.

5. The invention according to claim 4 including further mounting means for securing said connector to said loudspeaker, said mounting means comprising a tang on the back of said loudspeaker which is integral with the molded plastic loudspeaker frame and a molded part thereof, and flange portions at the back of said connector tightly fitted over said tang.

6. The invention according to claim 5 wherein said flexible moving leads are of predetermined length equal to the distance between the coil and said slots in the terminal receptacle added to about one and one-half to two times the excursion of said voice coil during acoustic radiation.

7. A method for adjusting the length and for securing the flexible moving electrical input leads of a moving coil loudspeaker which are joined at one end to fixed locations on the diaphragm of the speaker in order to be connected to a signal power source for energizing the voice coil comprising:

providing a solderless connector in secured relation to the back of the loudspeaker;

said solderless connector comprising terminal receptacles having a cavity to allow insertion of a blade at each end, a blade connector for each receptacle and each connector fastened at its back end to a lead going to the signal power source plus a voice coil, a detent in each of said receptacles, a detent projection on each terminal blade to provide a locked fit of the terminal blades in the receptacles;

lacing said moving leads into said cavity;

inserting a dressing fixture having a suitable size and secured relationship to the back of the loudspeaker;

pulling said flexible leads taut while inserting the blade of each connector so that detent on the blade locks into solderless terminal blocks; and removing said dressing fixture.

* * * * *

UNITED STATES PATENT OFFICE

CERTIFICATE OF CORRECTION

PATENT NO. : 4,068,103

DATED : January 10, 1978

INVENTOR(S) : JOHN A. KING ET AL

It is certified that error appears in the above-identified patent and that said Letters Patent are hereby corrected as shown below:

| | |
|---|---|
| Column 2, line 4 | "tend" should read -- tending -- |
| Column 2, line 65 | "frequency" should read -- frequencies -- |
| Column 3, line 35 | "space" should read -- spade -- |
| Column 3, line 50 | "space" should read -- spade -- |
| Column 3, line 51 | "series" should read -- serves -- |
| Column 3, line 62 | "survaces" should read -- surfaces -- |
| Column 4, line 38 | "eliminating" should read -- eliminate -- |
| Column 4, lines 49 and 50 | delete -- , which is incorporated herein by reference, -- |
| Column 4, line 55 | after "in" insert -- the present invention in Fig. 2 -- |
| Column 4, line 56 | delete -- Figs. 1 and 2 -- |
| Column 5, line 31 | "48" should read -- 43 -- |
| Column 5, line 32 | "46" should read -- 40 -- |
| Column 5, line 39 | "weed" should read -- weld -- after "12." insert -- Fig. 5 illustrates the terminal 14 in elevation. -- |

UNITED STATES PATENT OFFICE

CERTIFICATE OF CORRECTION

PATENT NO. : 4,068,103

DATED : January 10, 1978

INVENTOR(S) : JOHN A. KING ET AL

It is certified that error appears in the above-identified patent and that said Letters Patent are hereby corrected as shown below:

| | |
|---|---|
| Column 5, lines 43 and 44 and 45 | delete -- , which represents the alternate embodiment which is shown in Figs. 9-11 -- after "basket," insert -- shown in detail in Fig. 11 -- |
| Column 5, line 57 | delete -- in Fig. 1 -- after "shown" insert -- variously in Figs. 1 and 2 -- |
| Column 5, line 60 | "cones" should read -- cone -- |
| Column 5, lines 65 66, 67, and 68 | delete -- The bottom part of the pigtails 30 from the voice coil as shown in Fig. 2 must be immobilized at the inner center part of the frame below the cone 22 in order to provide movement of the cone and for this purpose an -- |
| Column 6, line 1 | delete -- adhesive connection -- before "32" insert as new paragraph -- As shown in Fig. 2 and adhesive connection -- |
| Column 6, line 2 | delete -- back (or rear) -- after "the" insert -- concave -- |

UNITED STATES PATENT OFFICE

CERTIFICATE OF CORRECTION

PATENT NO. : 4,068103

DATED : January 10, 1978

INVENTOR(S) : JOHN A. KING ET AL

Figure 7:
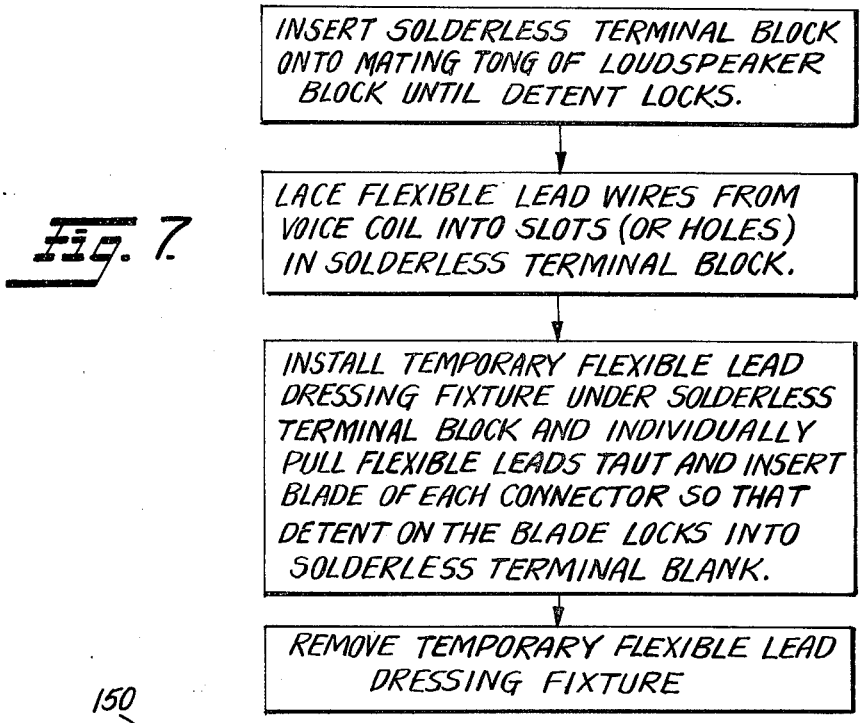
FIG. 7 is a blocked diagram describing the steps for assembling the solderless connectors to a speaker.

It is certified that error appears in the above-identified patent and that said Letters Patent are hereby corrected as shown below:

| | |
|---|---|
| Column 6, line 7 | delete -- as shown in Fig. 2 -- |
| Column 6, line 9 | "pigtail" should read -- lead -- |
| Column 6, line 15 | delete -- 32 -- |
| Column 6, line 17 | delete -- 20 -- |
| Column 6, line 30 | "10 and 11" should read -- 9 and 10 -- after "11" insert -- and as described in the component steps of Fig. 7.-- |
| Column 6, line 48 | "10 and 11" should read -- 9 and 10 -- |
| Column 6, line 65 | "11" should read -- 9 -- |
| Column 6, line 67 | "11" should read -- 9 -- |
| Column 6, line 56 | "Terminal" should read -- terminal -- |
| Column 6, line 68 | delete -- 32 in Fig. 11 -- after "at" insert -- 33 in Figs. 9 and 10-- |
| Column 7, line 11 | "9" should read -- 8 -- |
| Column 7, line 12 | "Terminal" should read -- terminal -- |

UNITED STATES PATENT OFFICE

CERTIFICATE OF CORRECTION

PATENT NO. : 4,068,103

DATED : January 10, 1978

INVENTOR(S) : JOHN A. KING ET AL

It is certified that error appears in the above-identified patent and that said Letters Patent are hereby corrected as shown below:

| | |
|---|---|
| Column 7, line 50 | "13" should read -- 123 -- |
| Column 7, line 54 | delete -- The -- after "piece." insert -- In Fig 6 the -- |
| Column 7, line 56 | delete -- 50 -- |
| Column 7, line 60 | delete -- of Fig. 5, and 6, -- |
| Column 7, line 64 | "tank" should read -- tang -- |
| Column 8, line 18 | "connector" should read -- connection -- |
| Column 8, line 63 | after "wherein" insert -- the freely moving portions of -- |
| Column 8, line 64 | delete -- coil -- and insert therefor -- ends fixed to the diaphragm -- |

UNITED STATES PATENT OFFICE

CERTIFICATE OF CORRECTION

PATENT NO. : 4,068,103

DATED : January 10, 1978

INVENTOR(S) : JOHN A. KING ET AL

It is certified that error appears in the above-identified patent and that said Letters Patent are hereby corrected as shown below:

Column 10, line 5 delete -- coil -- and insert therefor -- ends fixed to the diaphragm --

Signed and Sealed this

*Twelfth* Day of *September 1978*

[SEAL]

*Attest:*

RUTH C. MASON
*Attesting Officer*

DONALD W. BANNER
*Commissioner of Patents and Trademarks*